US007440358B2

(12) United States Patent
Lassalle

(10) Patent No.: US 7,440,358 B2
(45) Date of Patent: Oct. 21, 2008

(54) VISUAL INDICATING DEVICE

(75) Inventor: Laurence Lassalle, London (GB)

(73) Assignee: ScrewTime Ltd., London (GB)

( * ) Notice: Subject to any disclaimer, the term of this patent is extended or adjusted under 35 U.S.C. 154(b) by 204 days.

(21) Appl. No.: 10/532,596

(22) PCT Filed: Oct. 27, 2003

(86) PCT No.: PCT/GB03/04657

§ 371 (c)(1),
(2), (4) Date: Oct. 18, 2005

(87) PCT Pub. No.: WO2004/038516

PCT Pub. Date: May 6, 2004

(65) Prior Publication Data

US 2006/0104160 A1 May 18, 2006

(30) Foreign Application Priority Data

Oct. 25, 2002 (GB) ..... 0224874.8

(51) Int. Cl.
*G04B 19/20* (2006.01)

(52) U.S. Cl. ..... 368/77

(58) Field of Classification Search ..... 368/77
See application file for complete search history.

(56) References Cited

U.S. PATENT DOCUMENTS

| | | | | |
|---|---|---|---|---|
| 2,011,517 | A | 8/1935 | Geoffrion | |
| 2,451,250 | A * | 10/1948 | Springer | 368/109 |
| 2,785,530 | A * | 3/1957 | Mayer | 368/233 |
| 4,939,708 | A * | 7/1990 | Pincemy | 368/233 |
| 5,088,440 | A * | 2/1992 | Keaney | 116/298 |
| 6,683,821 | B1 * | 1/2004 | Emtyazi | 368/77 |

FOREIGN PATENT DOCUMENTS

| | | |
|---|---|---|
| DE | 20 15 446 A | 11/1970 |
| DE | 3731872 A1 | 8/1988 |

* cited by examiner

*Primary Examiner*—Edwin A. Leon
*Assistant Examiner*—Thanh S Phan
(74) *Attorney, Agent, or Firm*—Dickstein Shapiro LLP

(57) ABSTRACT

A visual indicating device comprising two or more discs (1, 2) each disc having a radial discontinuity (3, 4) to thereby form a surface of which the plane progresses in a helical manner, said discs being superposed and interleaved and lying in mutually parallel helical planes, each disc being independently rotatable about a common axis (5, 6) by drive means (20, 22, 30, 31) adapted to selectively rotate one (1) or other (2) of the discs, whereby the discs, when viewedaxially face on, display overlapping visually contrasting segments having an area or position representative of the relative positions of rotation of the discs and representing a value of a parameter to be displayed by the device.

11 Claims, 11 Drawing Sheets

VISUAL INDICATING DEVICE

Figure 1:
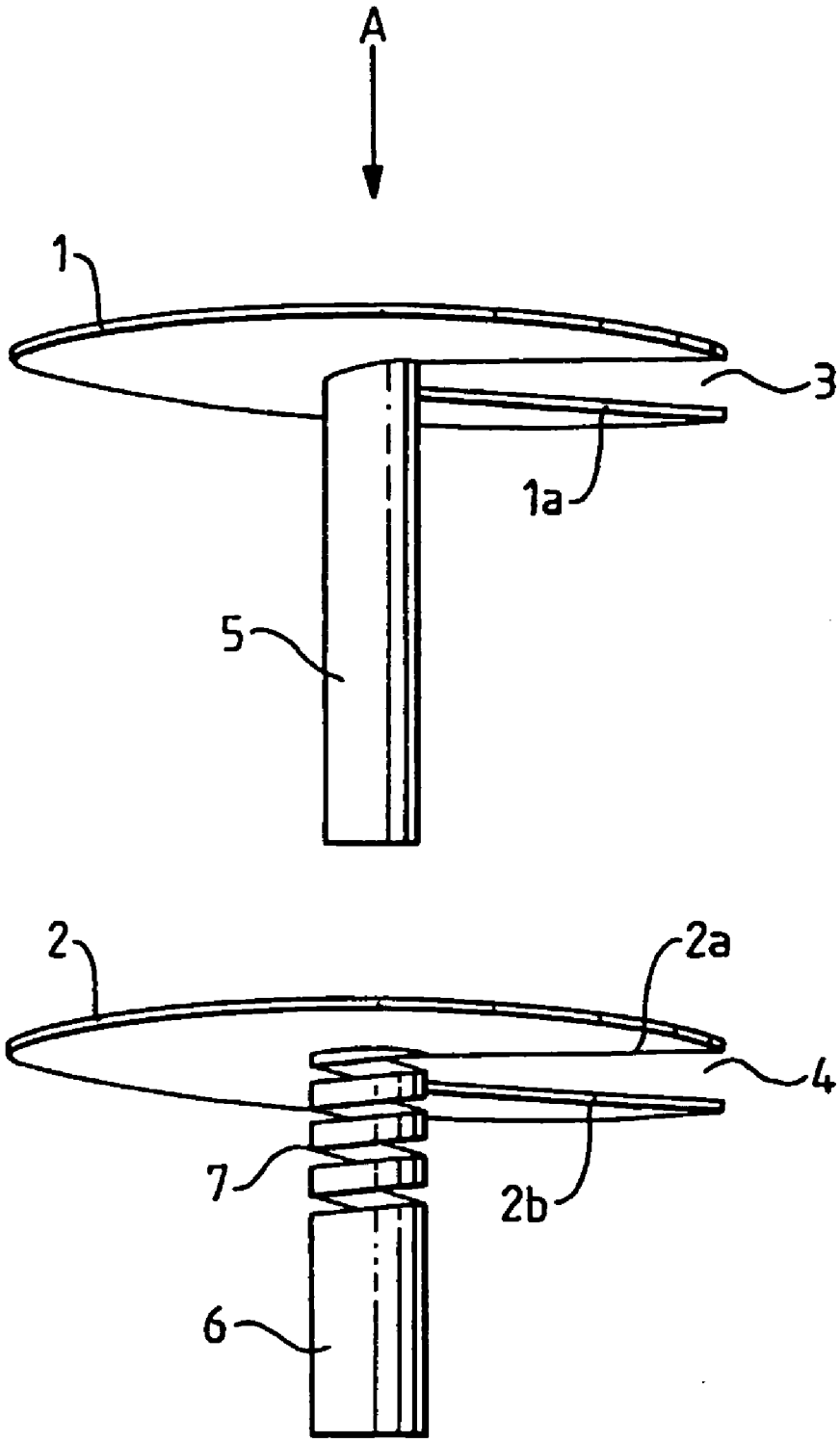

This invention relates to a visual indicating device and more particularly to an analogue device for showing the time or elapse of time. It is to be understood that the device of this invention may be used generally to indicate various parameters such as are shown on customary analogue dial or gauge indicating devices.

In accordance with this invention there is provided a visual indicating device comprising two or more discs each disc having a radial discontinuity to thereby form a surface of which the plane progresses in a helical manner, said discs being superposed and interleaved and lying in mutually parallel helical planes, each disc being independently rotatable about a common axis by drive means adapted to selectively rotate one or other of the discs, whereby the discs, when viewed axially face on, display overlapping visually contrasting segments having an area or position representative of the relative positions of rotation of the discs and representing a value of a parameter to be displayed by the device.

One disc may be mounted to extend laterally from a shaft, the other disc may be mounted to extend from the surface of a cylinder in which the shaft rotates. The shaft being mounted coaxially within the cylinder with the cylinder having a helical slot in the wall thereof and through which the disc mounted on the shaft may extend. Rotation of the shaft relative to the cylinder producing relative axial movement between the shaft and the cylinder by virtue of the disc riding in the slot in the cylinder and causing the one disc which is overlying the other disc to mask, or expose, the other disc by an extent dependent on the relative positions of rotation.

An end of the shaft may include a drive, such as an integral cog with an associated drive means. The shaft being driven during one half a revolution of the drive means, the outer cylinder being driven for the other one half revolution of the drive means. By this means the outer cylinder, when held against rotation, moves down telescopically over the shaft during rotation of the latter after which, in a terminal position, the outer cylinder is then rotated to move up over the shaft which is held against rotation.

The outer cylinder may comprise a barrel member which embraces the inner shaft also comprising a coaxially located barrel member. More than two barrels may be provided functioning within in a similar manner.

Figure 2:
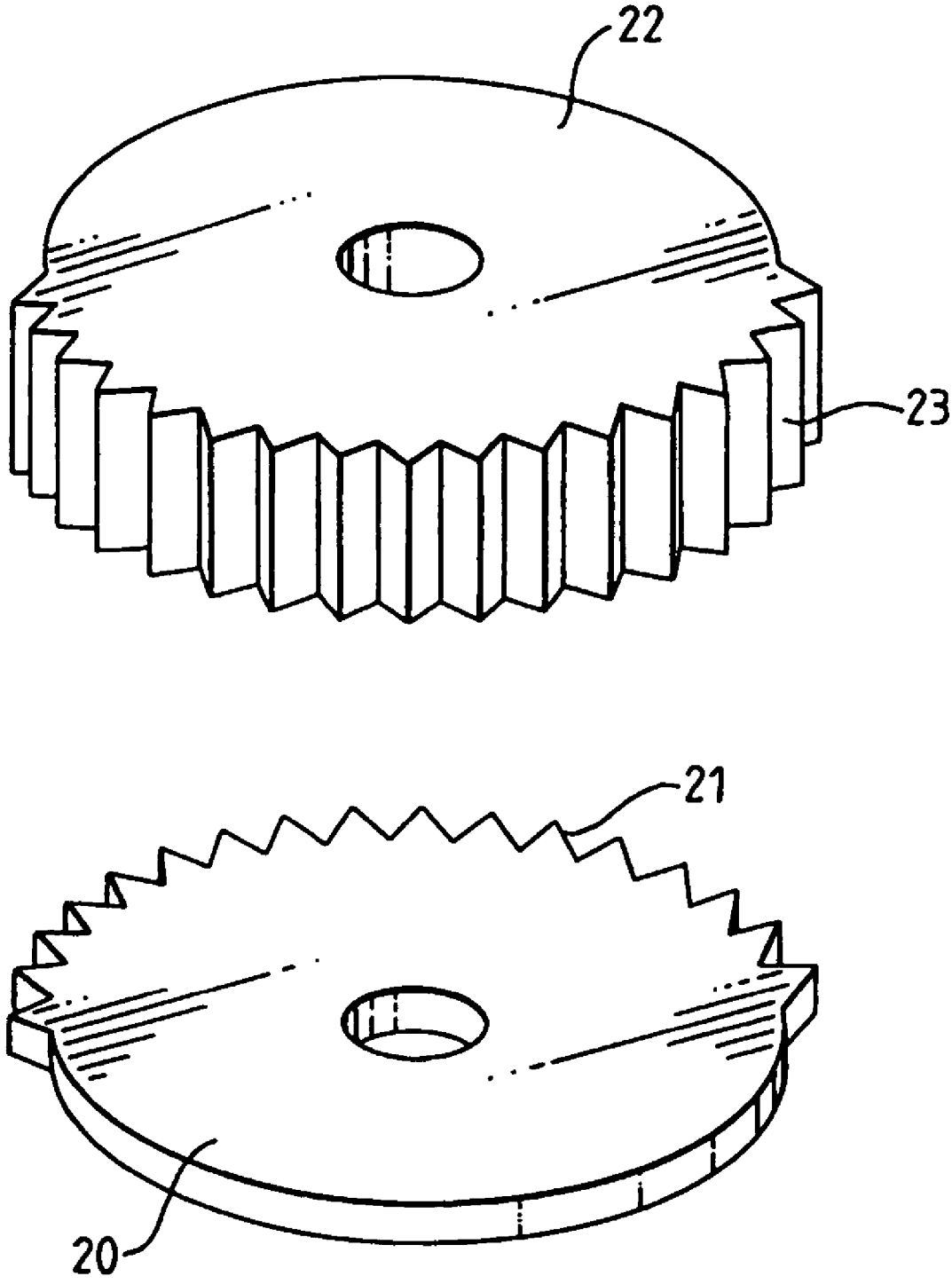
Figure 6:
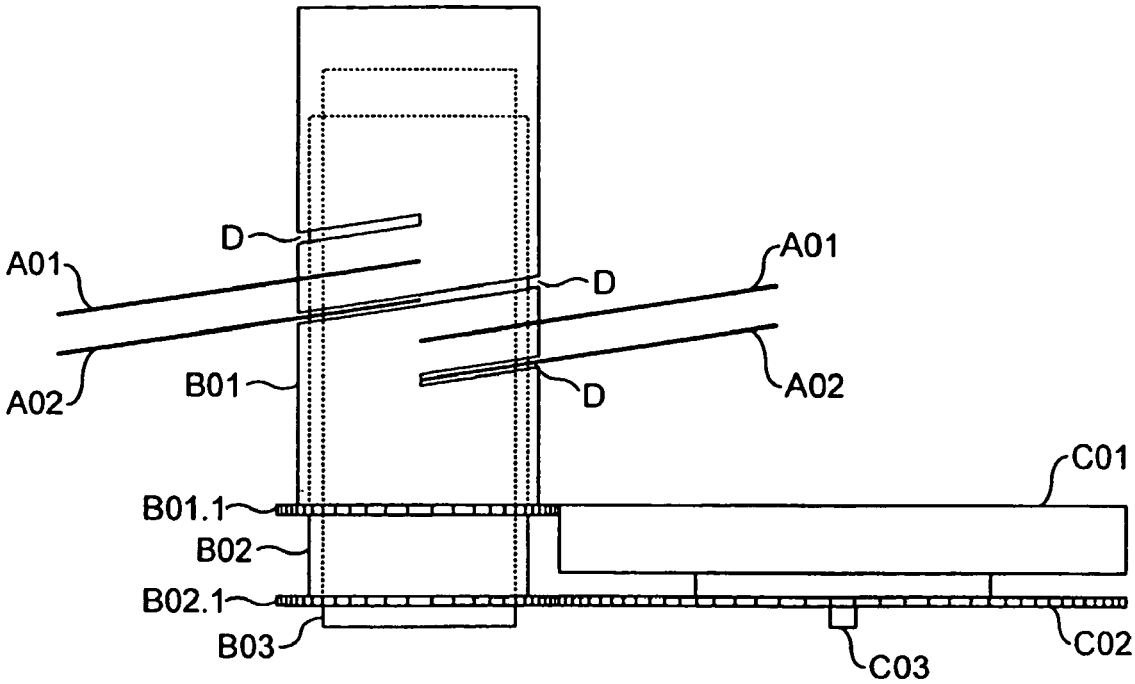
Figure 7:
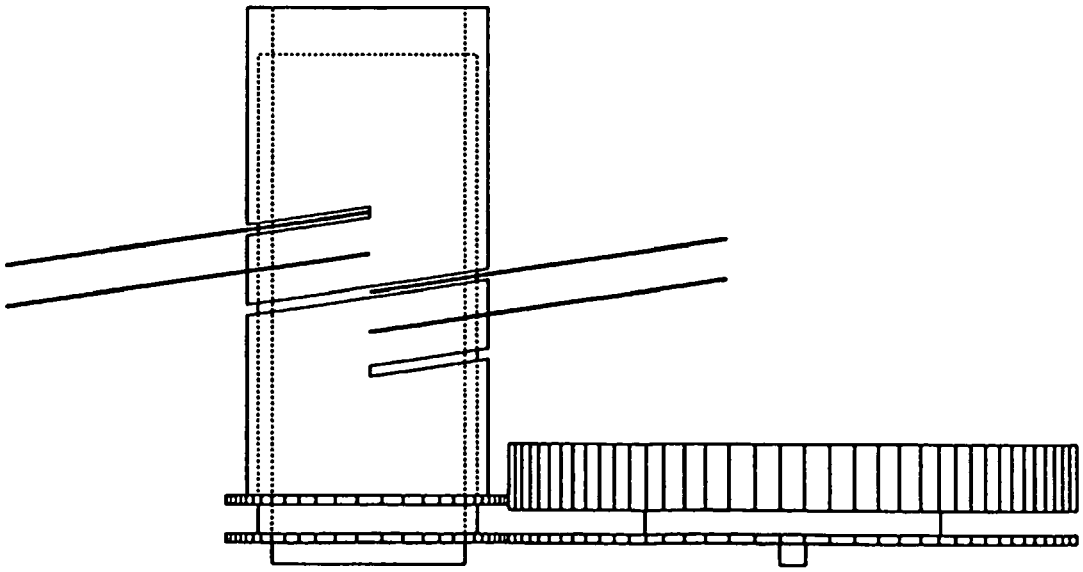
Figure 8A:
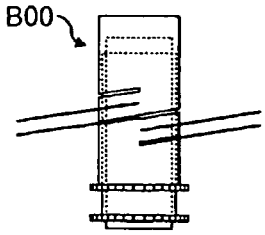
Figure 8B:
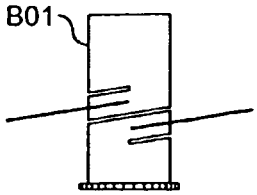
Figure 8C:
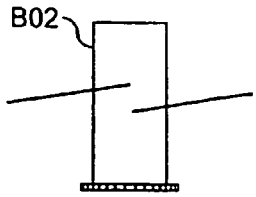
Figure 8D:
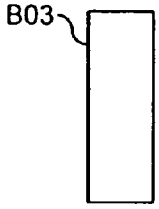
Figure 9A:
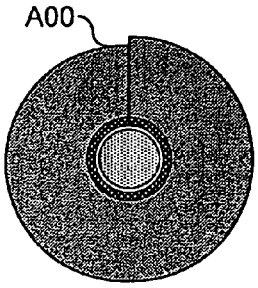
Figure 9B:
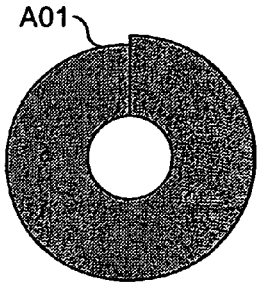
Figure 9C:
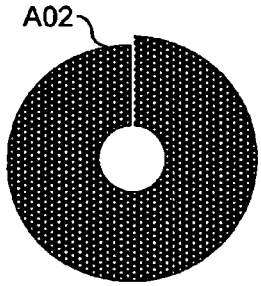
Figure 9D:
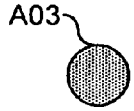

This invention is more particularly described with reference to the drawings showing, in a diagrammatic way, one embodiment of a time indicating device in accordance with this invention. In the drawings:

FIG. 1. shows two disc parts, separated, which provide the visual indication when interleaved;

FIG. 2. shows the gear assembly parts, separated, which rotates the discs;

FIG. 3. *a*) to *c*) shows an assembled basic device, according to this invention, in side view and in three positions of rotation;

FIG. 4. *a*) to *c*) shows a detail of the drive gearing, seen from below;

FIG. 5. *a*) to *d*) shows the discs, face-on, in four positions of rotation;

FIG. 6. shows another embodiment of the device in side elevation;

FIG. 7. shows the device of FIG. 6 in an alternative position;

FIG. 8. *a*) shows the individual barrel components assembled and in side elevation, and *b*) to *d*) show the individual barrel components separated in side elevation;

FIG. 9. *a*) to *d*) show in plan view the barrels and discs attached to the barrels corresponding in views to FIG. 8;

FIG. 10. *a*) to *d*) shows the drive cogs for each barrel in plan view corresponding in views to FIG. 8;

FIG. 11. *a*) to *d*) shows the drive cogs of FIG. 10 in side elevation;

FIG. 12. *a*) to *h*) shows plan views of the discs and the indications presented for various times of the day;

FIG. 13. *a*) to *d*) show in plan view a more complex arrangement with three disc and cylinder assemblies to show hours, minutes and seconds, and FIG. 14. *a*) to *d*) show the arrangement of FIG. 13 in side elevation.

The basic principle of this invention is now described with reference to FIGS. 1 to 5. As shown in FIG. 1, the basic device comprises two discs 1 and 2 wherein each disc has a radial discontinuity or cut 3 and 4 respectively whereby the disc then forms a surface of which the plane progesses in a helical manner. Disc 1 is mounted on a shaft 5 and disc 2 is mounted on a cylinder 6. The cylinder 6 has a helical slot 7 in the wall. The shaft 5 may be passed into the cylinder 6 and the edge 1*a* of the disc 1 may engage between the opening formed by the edges 2*a* and 2*b* of disc 2 whereby on rotation of disc 1 the edge 1*a* may pass between the edges 2*a* and 2*b* and extend below the disc 2 whilst at the same time the inner part of the disc moves along the helical slot 7. In this way both the discs may become superposed and interleaved and thus lie in mutually parallel helical planes with one disc overlying the other as seen in end view looking in direction A. Thus the relative positions of rotation of the discs 1 and 2 will cause differing exposures of the end faces of one or other of the discs, such that the relative position of rotation can be visually appreciated. Thus from a starting position where the edge 1*a* is just entering the gap between the edges 2*a* and 2*b* of disc 2, disc 1*a* will be fully exposed and as disc 1*a* rotates in a clockwise direction the surface of disc 2 will be progressively exposed until disc 1 lies wholly beneath disc 2. If disc 2 is then rotated in a similar clockwise direction the surface will pass beneath the disc 1 to a position where the whole of the surface of disc 1 will again be exposed.

In order to provide for this sequence of progressively covering over the surface of disc 1 and thereafter uncovering the surface whilst maintaining a continuous clockwise direction of rotation, shaft 5 of disc 1 may be considered as relatively fixed to a base member whereas the cylinder 6 and disc 2 are free to ride up and down over shaft 5. Thus by rotating shaft 5 in a clockwise direction, cylinder 6 will move upwards with disc 2 to an initial limit position after one full revolution of shaft 5. If at this point shaft 5 is stopped from rotation but shaft 6 is then rotated in a clockwise direction, disc 1 will progressively be exposed whilst the cylinder 6 moves downwards on the shaft 5. This sequence will be repeated for as long as shaft 5 and cylinder 6 are sequentially rotated in a clockwise direction with firstly one revolution of shaft 5 followed by one revolution of cylinder 6.

FIG. 2 shows one means of achieving this and there is shown a gear which has two portions being a lower portion 20 with a plurality of teeth 21 extending around 180° of the circumference and with a second portion 22 with a second plurality of teeth 23 extending around the diametrically opposed 180° of the circumference.

The lower end of shaft 5 includes the gear which engages the gear teeth 21 on portion 20 and the cylinder 6 has a similar gear which engages the gear teeth 23 on the portion 22. The gears on shaft 5 and cylinder 6 extend around the whole 360° of the circumference but the number of teeth correspond to the number of teeth on the gear parts 21 and 23. Thus 180° revolution of the gear 20, 22 produces a full revolution of shaft 5 or cylinder 6. The gear teeth 23 on the portion 22 are sufficiently wide in order that the gear of cylinder 6 may remain in engagement as the cylinder moves longitudinally along shaft 5.

Figure 3A:
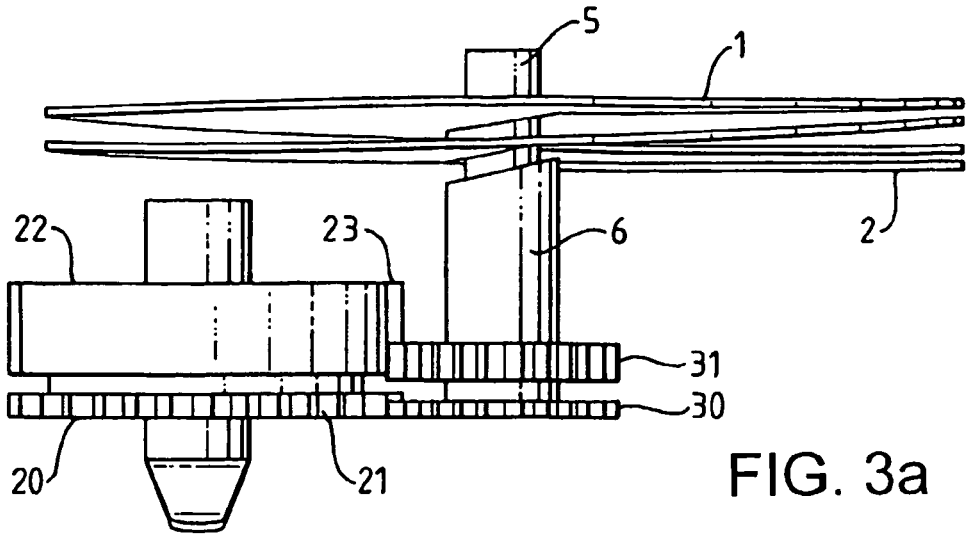
Figure 3B:
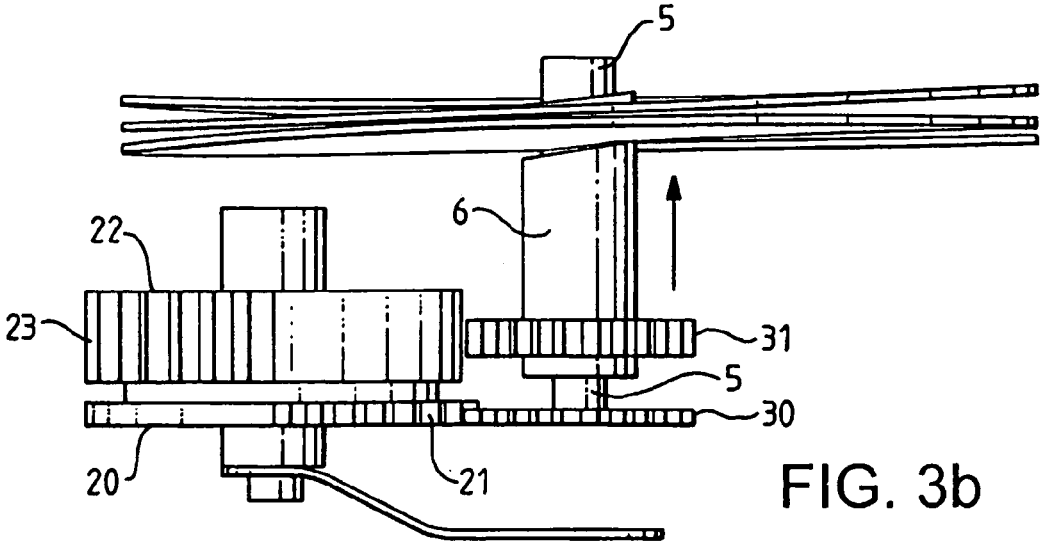
Figure 3C:
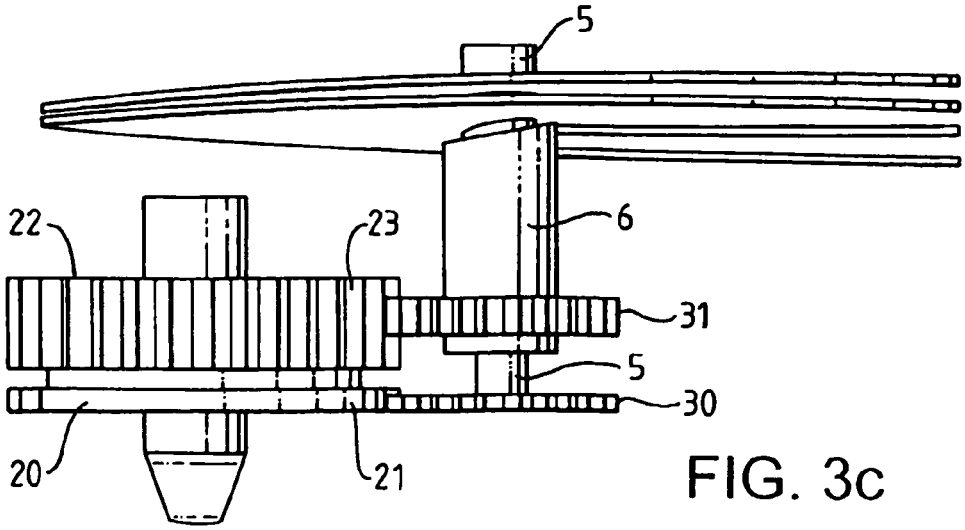

The assembly is shown in FIGS. 3*a* to 3*c* in side view and as may be seen, a gear 30 is secured to the end of shaft 5 which carries disc 1 and a gear 31 is secured around the outside of cylinder 6 which carries the disc 2. Referring to FIG. 3*a*, as the gear assembly 20, 22 is rotated in an anticlockwise direction seen from above, the teeth 21 engage the gear 30 and thus rotate shaft 5 clockwise causing the cylinder 6 to be moved upwardly as disc 1 progressively moves beneath disc 2. FIG. 3*b* shows the position after 90° of revolution of 20, 22 and in the position shown in FIG. 3*c* the teeth 21 are about to disengage from the gear 30 after 180° revolution of 20/22 and thus 360° revolution of gear 30. At this point, gear teeth 23 now commence engagement with gear 31 and cylinder 6 is caused to rotate in a clockwise direction (as seen from above) which now causes the cylinder 6 to move downardly and thus for disc 2 to move beneath disc 1. After a further 180° revolution, gear teeth 23 now disengage from gear 31 and gear teeth 21 re-engage with gear 30, thus the sequence of disc covering and uncovering proceeds continuously for as long as the gear 20, 22 is rotated in the same direction.

In order to prevent friction rotating the the shaft 5 or cylinder 6 when disengaged from a respective gear part 21 or 22, a ratchet means is provided (not shown here) or sufficient friction is applied to the shaft or cylinder to prevent rotation. This can conveniently be achieved through a thin ratchet blade engaging gear 30 and gear 31 whereby positive rotation of either part overcomes the bladed force.

Figure 4A:
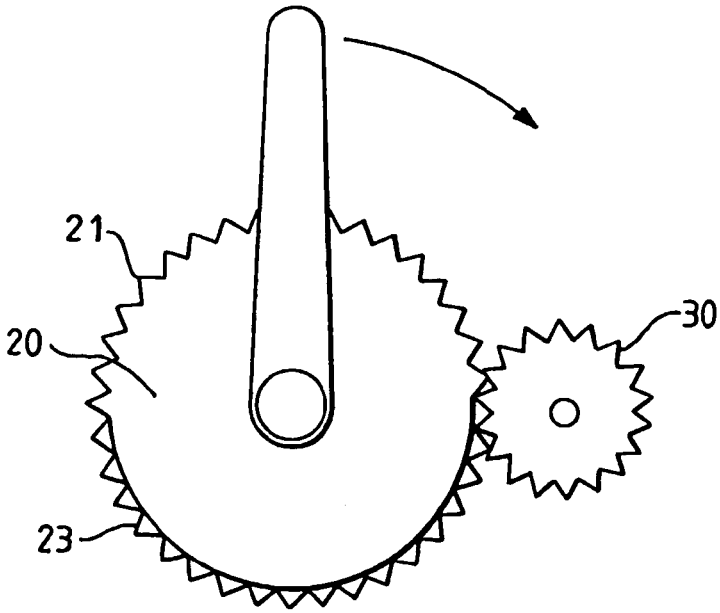
Figure 4B:
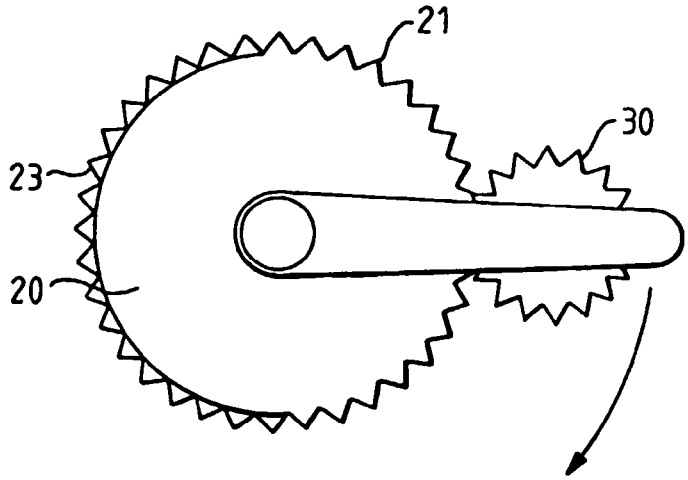
Figure 4C:
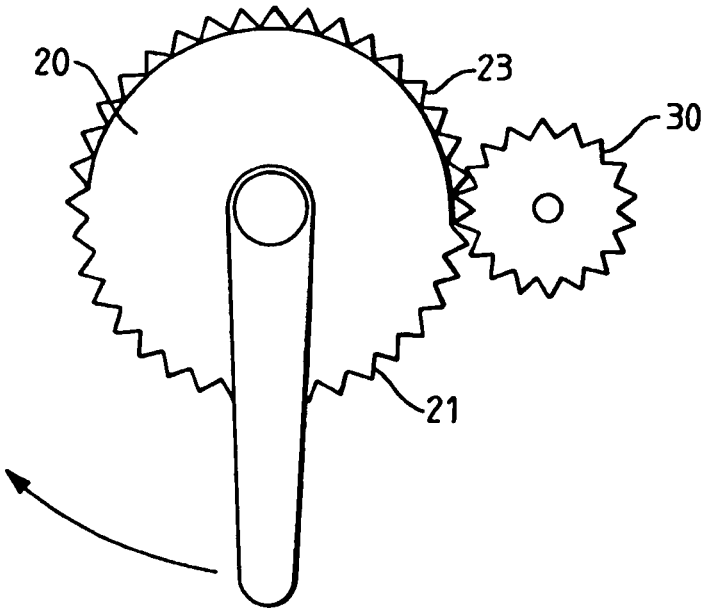
Figure 5A:
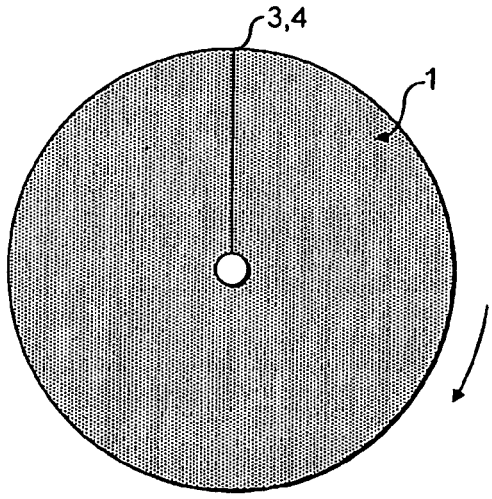
Figure 5B:
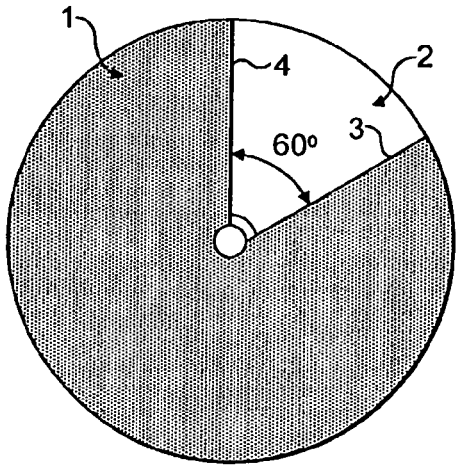
Figure 5C:
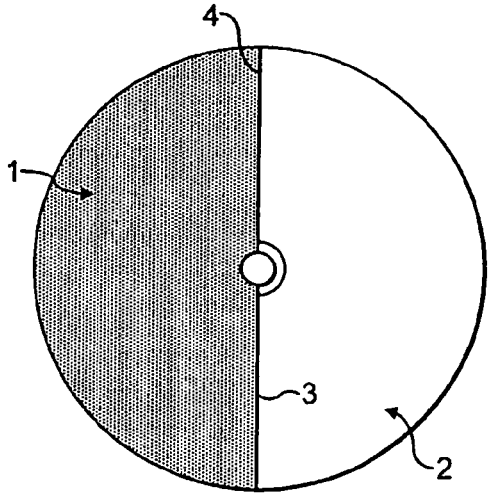
Figure 5D:
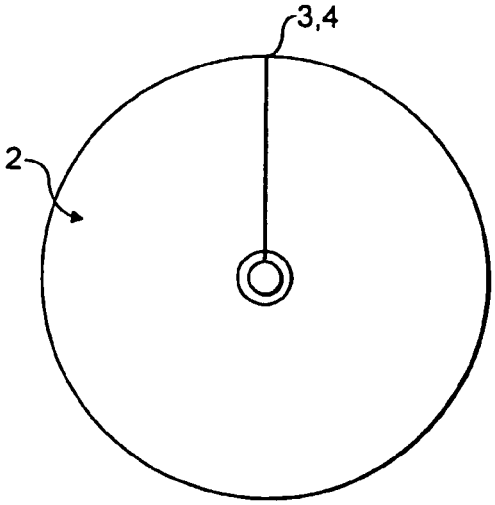

FIGS. 4*a, b* and *c* show the gears viewed from below as shown in FIG. 3 and in the same relative positions as in FIGS. 3*a*, 3*b* and 3*c*. As may be seen in FIG. 4*a*, the gear teeth 21 are commencing engagement with gear 30, in FIG. 4*b* the rotation of shaft 5 is half way through the sequence and in FIG. 4*c* the complete revolution of shaft 5 is finished and gear teeth 23 are now commencing engagement with gear 32 (not shown here). FIGS. 5*a* to 5*d* show the discs viewed in the direction of arrow A in FIG. 1, and in FIG. 5*a* there is shown the position of the discs corresponding to FIG. 3*a* with shaded disc 1 fully overlying unshaded disc 2. FIG. 5*b* shows an intermediate position after approximately 45° of rotation of shaft 5 with a disc 2 being shown partially uncovered. FIG. 5*c* corresponds to the position shown in FIG. 3*b*, with disc 2 now uncovered by one half and in FIG. 5*d* there is shown the position of FIG. 3*c* with disc 2 now fully uncovered. Further rotation will now cause disc 1 to emerge from beneath disc 2 and to progressively cover the surface as gear 31 rotates to move cylinder 6 downwards.

In a practical application for a timepiece, the gears 20, 22 will be rotated once every 24 hours. Thus the position shown in FIG. 5*a* might, for example, represent midnight, the position shown in FIG. 5*b* might represent 3 a.m., the position shown in FIG. 5*c* might represent 6 a.m. and the position shown in FIG. 5*d* would represent midday, that is with the whole of disc 2 (the lighter coloured disc) exposed. For the next 180° revolution of 20, 21 the unshaded disc would progressively uncover the shaded disc and this would then represent time after midday and progressing up to midnight, where the shaded disc would be fully exposed.

By this means, the device according to this invention in its basic form, can provide a very quick and readily appreciated visual indication of the time, or indeed any other parameter, which requires an indication to be presented on a time advancing basis.

There now follows a description of further embodiments of this invention which utilise a more practical arrangement having two concentric cylinders, although the principal of operation is as previously described.

Referring to FIGS. 6 to 11 of the drawings the device has three concentric cylinders B01, B02 and B03 forming barrel system B00. Outer cylinder B01 is free to slide up and down the inner cylinder B02 which, in turn, is mounted over the central base cylinder B03. The cylinders are all freely and relatively rotatable. The base cylinder B03 forms a support for the device and may include a mounting means.

Outer cylinder B01 has a base mounted cog B01.1 and inner cylinder B02 has a base mounted cog B02.1 forming the barrel and barrel cog system B00. The cylinder B01 is provided with a helical slot D through the wall, and here shown with two complete turns around the circumference, and a helical disc A01 (forming part of disc system A00) extending one turn around the circumference medially within the confines of the circumference defined by the slot and fixed in position to the outer surface of the cylinder.

The inner cylinder B02 also has a single turn disc A02 (forming the other part of disc system A00) arranged so that the disc may extend through the slot D. In this arrangement rotating cylinder B01 clockwise (as seen from above) from the position shown in FIG. 1 results in the terminal position shown in FIG. 7 after one full revolution, and vice versa. This action occurs as inner cylinder B02 is stationary and the slot D thus rides down along the discA02.

If, conversely, and from the position of FIG. 7 cog B02.1 rotates inner cylinder clockwise then disc A02 is caused to travel down the slot D and the cylinders thus return to the position of FIG. 6.

The cogs B01.1 and B02.1 are each driven through cogs C01 and C02 respectively by a drive C03 forming cog system C00 and turning one revolution for each twenty four hour period. The cogs C01 and C02 are twice the diameter of the barrel cogs B01.1 and B02.1 and have engagement teeth around only one half of the circumference and phased by 180°. Thus when the teeth of C01 disengage from B01.1 after twelve hours (position of FIG. 7) the teeth on C02 then engage B02.1 and outer cylinder B01 stops rotating and inner cylinder B02 starts rotating back to the FIG. 6 position after an elapse of a further twelve hours.

Figure 10A:
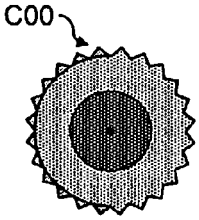
Figure 10B:
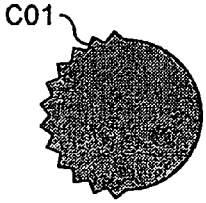
Figure 10C:
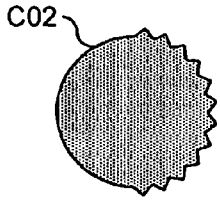
Figure 10D:
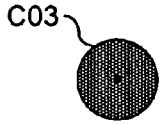
Figure 11A:
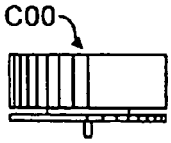
Figure 11B:
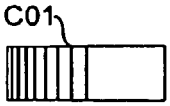
Figure 11C:
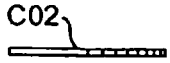
Figure 11D:
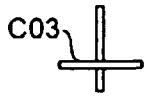
Figure 12A:
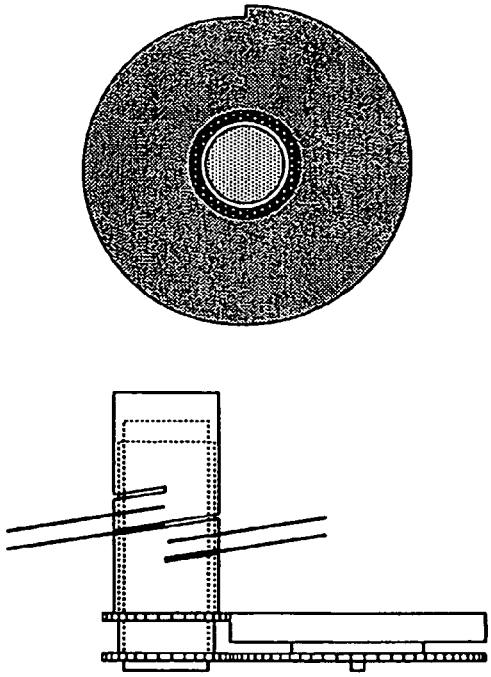
Figure 12B:
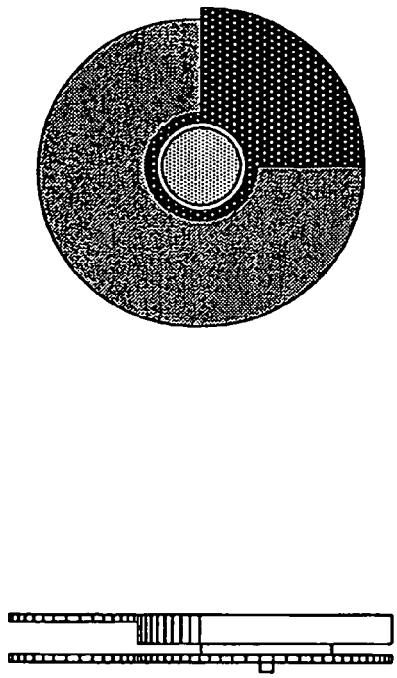
Figure 12C:
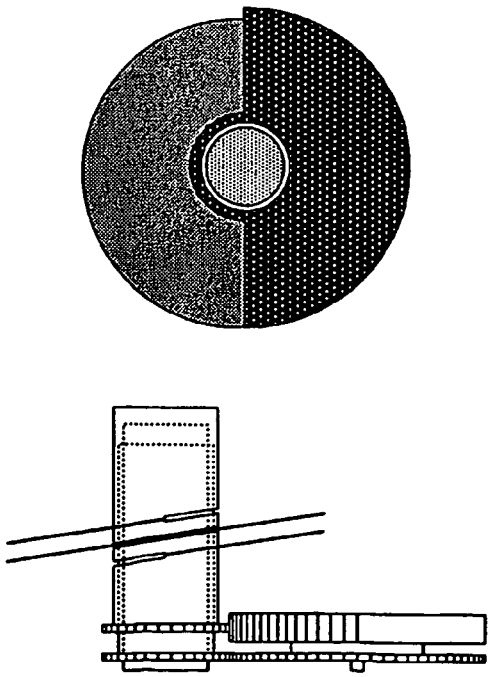
Figure 12D:
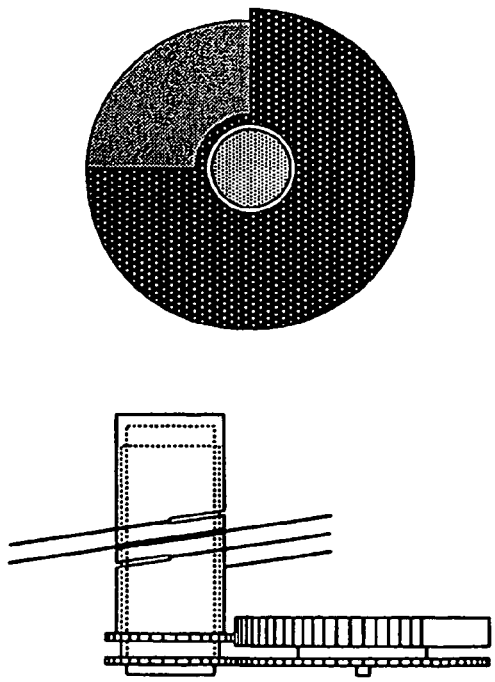
Figure 12E:
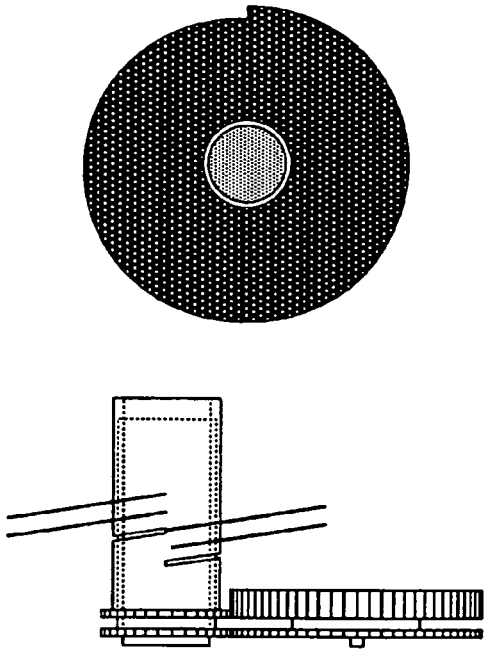
Figure 12F:
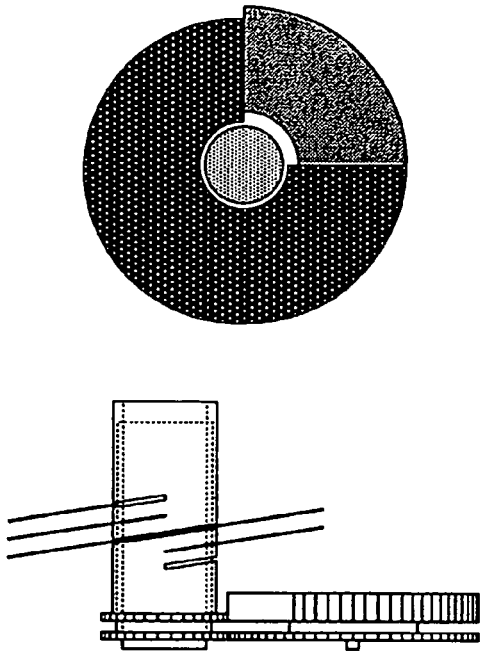
Figure 12G:
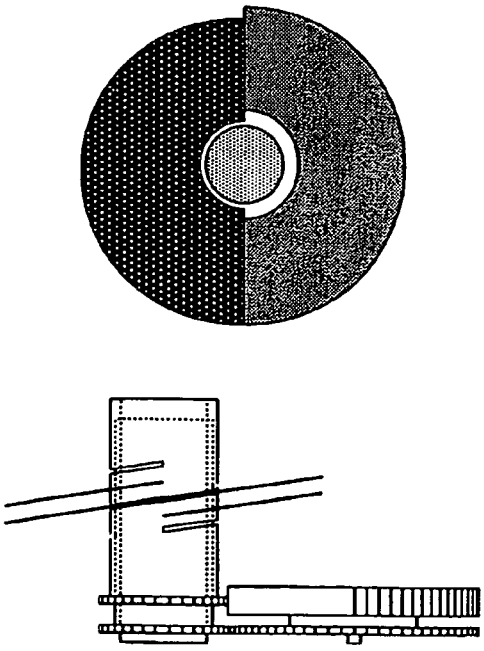
Figure 12H:
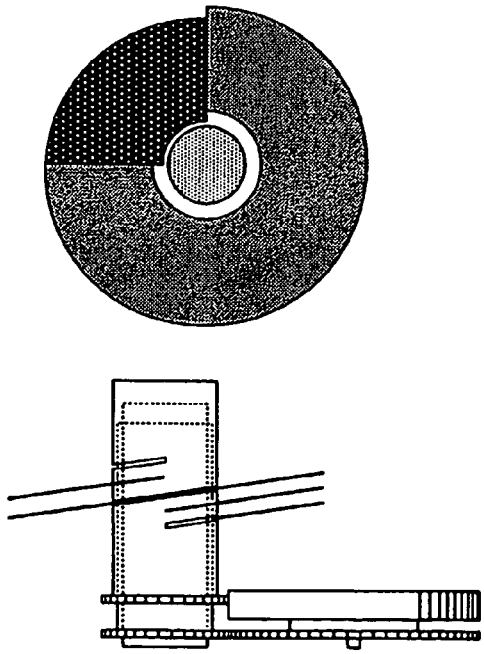
Figure 13A:
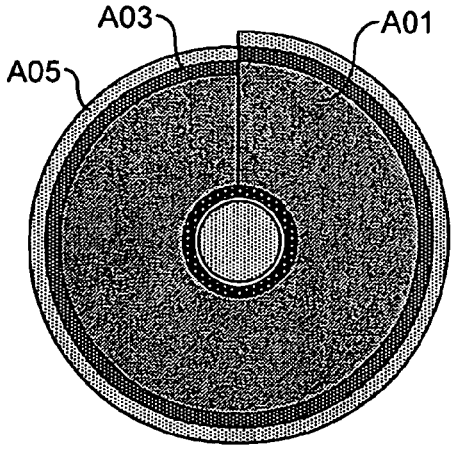
Figure 13B:
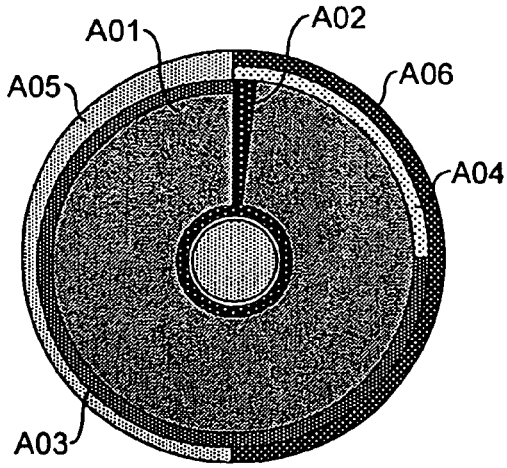
Figure 13C:
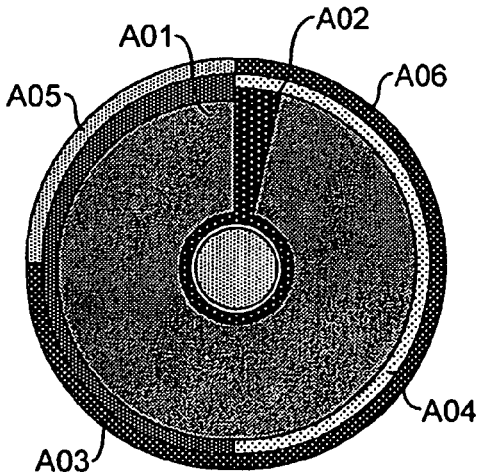
Figure 13D:
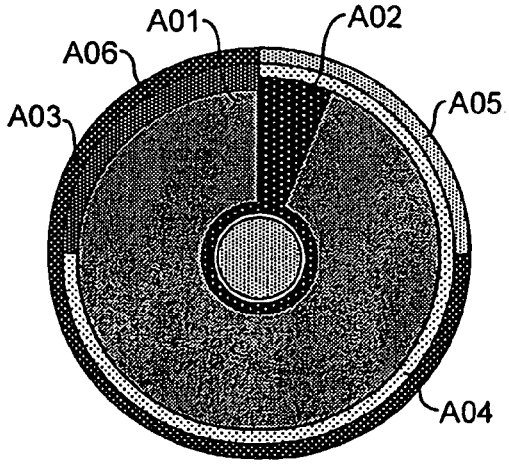
Figure 14A:
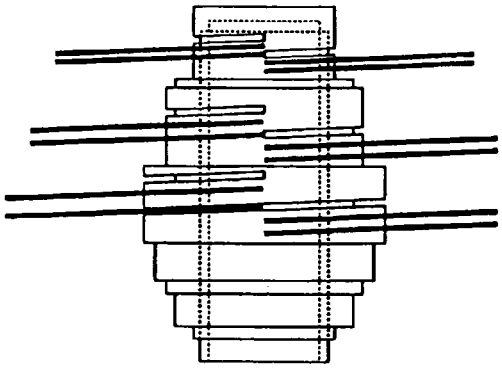
Figure 14B:
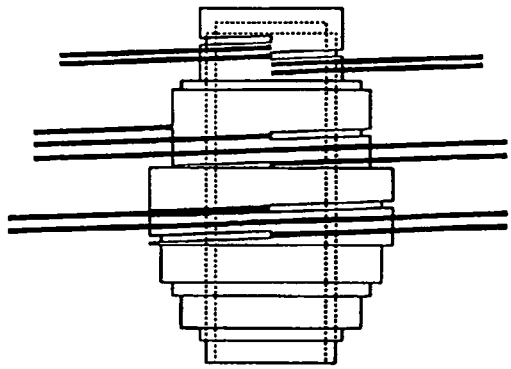
Figure 14C:
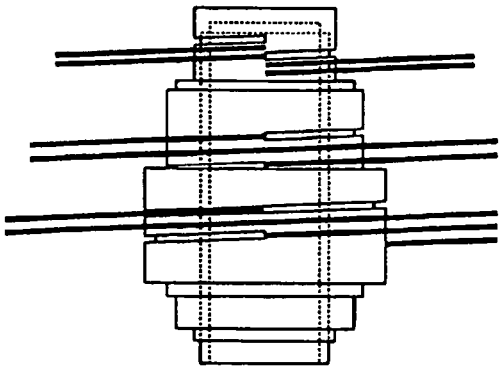
Figure 14D:
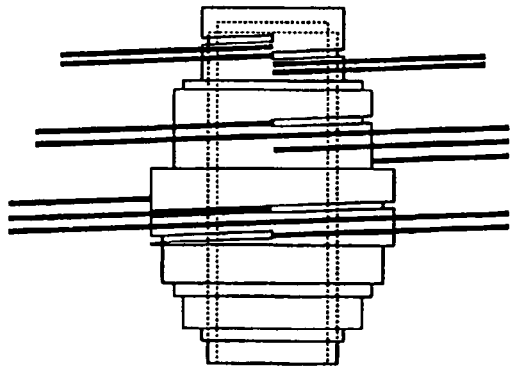

FIGS. 8 to 11 shown the components in more detail and FIG. 5*b* an *c*shows the configuration of the teeth on cogs C01 and C02 more clearly with FIG. 10*a* showing the superimposed teeth.

The discs A01 and A02 have contrasting colours and when viewed from above the visual aspect is of different colour segments according to the relative rotational positions from which there is an indication of time. FIG. 12A to H shows eight different visual presentations for three hourly times from 12:00 p.m. through 12:00 a.m. to 9:00 p.m. This involves on revolution of C03 for each twenty four hour period. In an alternative arrangement the discs may have different textures, be of different materials or of different shades or patterns.

FIGS. 13 and 14 are views of a more comprehensive indicating system showing three disc systems A01 and A02, A03 and A04, A05 and A06 for hours, minutes and seconds respectively. The hours discs A01 and A02 move and provide an indication as previously described. The minutes discs A03 and A04 and associated cylinders are located coaxially around the hours discs and the associated mechanism drives the discs in a similar manner but with the appropriate relative difference in timing. In a similar way the seconds discs A05 and A06 are located with the cylinders coaxially around the minutes and hours cylinders and driven to provide the correct time relationship.

The invention claimed is:

1. A visual indicating device comprising two or more discs each disc having a radial discontinuity to thereby form a surface of which the plane progresses in a helical manner, said discs being superposed and interleaved and lying in mutually parallel helical planes, each disc being independently rotatable about a common axis by drive means adapted to selectively rotate one or other of the discs, whereby the discs, when viewed axially face on, display overlapping visually contrasting segments having an area or position representative of the relative positions of rotation of the discs and representing a value of a parameter to be displayed by the device, wherein one disc is mounted to extend laterally from a rotatable shaft, the other disc being mounted to extend laterally from the outer surface of a rotatable cylinder within which the shaft rotates, the shaft being mounted coaxially within the cylinder, with the cylinder having a helical slot through which an inner portion of the one disc adjacent the shaft extends, rotation of the shaft relative to the cylinder producing relative axial movement between the shaft and the cylinder by virtue of the disc moving in the slot in the cylinder and causing the one disc which is overlying the other disc to mask, or expose, the other disc by an extent dependent on the relative positions of rotation.

2. A device in accordance with claim 1, wherein an end of the shaft is coupled to a drive means, the shaft being rotated by the drive means to produce a revolution of the shaft, the outer cylinder being coupled to the drive means and rotated by the drive means to produce a revolution of the cylinder, the shaft and cylinder being sequentially rotated by the drive means.

3. A device in accordance with claim 1, wherein an end of the shaft is coupled to a drive means, the shaft being rotated during one half a revolution of the drive means to produce a revolution of the shaft, the outer cylinder being coupled to the drive means and driven for the other one half revolution of the drive means to produce a revolution of the cylinder, the shaft and cylinder being sequentially rotated during continuous rotation of the drive means.

4. A device in accordance with claim 1, wherein the outer cylinder, when held against rotation and not driven, moves down telescopically over the shaft during rotation of the latter after which, in a terminal position, the outer cylinder is then rotated to move up over the shaft which is held against rotation and not driven, ratchet means being preferably provided to permit uni-directional rotation by the drive means.

5. A device in accordance with claim 1, wherein the outer cylinder comprises a barrel member which embraces the inner shaft which may also comprise a coaxially located barrel member.

6. A device in accordance with claim 1, wherein the drive means comprises a mechanism which, during operation, selectively engages the shaft for a revolution thereof and then engages the cylinder for a revolution thereof and in a cyclically continuous manner.

7. A device in accordance with claim 6, wherein the mechanism incorporates two superposed gears with complementary but non-aligned discontinuities in the peripheral teeth, the arrangement being such that teeth on one gear engage the shaft to drive same during part of a revolution and during which the teeth on the other gear are not in engagement with the cylinder which remains stationary.

8. A device in accordance with claim 1, modified in that drive means are coupled to the shaft and to the cylinder, each drive means being independently operated to rotate the shaft and cylinder to provide a differential indication of the relative positions of the drive means.

9. A device in accordance with claim 1, wherein more than two cylinders are provided, the cylinders being nested telescopically and each including a disc, the disc of a inner barrel passing through a slot in an outer barrel.

10. A device in accordance with claim 1, wherein a plurality of shaft and cylinder assemblies are located in axial alignment one above the other and arranged so that an edge at least of an underlying pair of discs is visible beneath an uppermost disc, whereby the totality of visible contrasting segments of the discs collectively represent a parameter to be displayed.

11. A device in accordance with claim 1, wherein the parameter to be displayed comprises time, either elapsed or absolute, each disc being rotated over a revolution equal to a conventional time period, such as twenty four or twelve hours or one minute, the relative positions of rotation of the discs and the angular zones displayed thus displaying a portion of the time period.

* * * * *